US007963632B2

(12) United States Patent
Umeda

(10) Patent No.: US 7,963,632 B2
(45) Date of Patent: Jun. 21, 2011

(54) DROPLET EJECTING DEVICE HAVING TILTABLE CHANNEL MEMBER

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 363 days.

(21) Appl. No.: 12/205,581

(22) Filed: Sep. 5, 2008

(65) Prior Publication Data

US 2009/0085966 A1 Apr. 2, 2009

(30) Foreign Application Priority Data

Sep. 27, 2007 (JP) ..... 2007-251305

(51) Int. Cl.
*B41J 2/165* (2006.01)
*B41J 2/19* (2006.01)
*B41J 2/175* (2006.01)

(52) U.S. Cl. ..... 347/32; 347/29; 347/30; 347/89; 347/90; 347/92; 347/93

(58) Field of Classification Search ..... 347/29, 347/30, 32, 89, 90, 92, 93
See application file for complete search history.

(56) References Cited

U.S. PATENT DOCUMENTS

| | | | | |
|---|---|---|---|---|
| 5,812,155 | A | 9/1998 | Seccombe | |
| 6,257,714 | B1 | 7/2001 | Seccombe | |
| 6,517,189 | B2 | 2/2003 | Ogawa et al. | |
| 2002/0063759 | A1 * | 5/2002 | Hirano et al. | 347/85 |

FOREIGN PATENT DOCUMENTS

| | | | |
|---|---|---|---|
| JP | H09-164703 | A | 6/1997 |
| JP | 2001232816 | A | 8/2001 |
| JP | 2005199600 | A | 7/2005 |

* cited by examiner

*Primary Examiner* — Ryan Lepisto
(74) *Attorney, Agent, or Firm* — Baker Botts L.L.P.

(57) ABSTRACT

A channel member formed with a liquid storing chamber and a communication channel is configured to be tilted together with a droplet ejecting head. A cap member is configured to be movable between: a standby position spaced away from a droplet ejecting surface; and a capping position at which the cap member is in close contact with the droplet ejecting surface and covers droplet ejecting openings. A cap drive section drives the cap member to move between the standby position and the capping position. When the cap drive section drives the cap member to move to the capping position, the cap member presses the droplet ejecting head, and the channel member is tilted together with the droplet ejecting head in such a manner that a connection section between the liquid storing chamber and the communication channel is located at a position higher than the liquid storing chamber.

12 Claims, 12 Drawing Sheets

DROPLET EJECTING DEVICE HAVING TILTABLE CHANNEL MEMBER

CROSS REFERENCE TO RELATED APPLICATIONS

This application claims priority from Japanese Patent Application No. 2007-251305 filed Sep. 27, 2007. The entire content of the priority application is incorporated herein by reference.

TECHNICAL FIELD

The invention relates to a droplet ejecting device that ejects liquid droplets.

BACKGROUND

An inkjet recording device serving as a droplet ejecting device that ejects droplets is conventionally known. The inkjet recording device records texts and images on a recording medium such as recording paper or the like, by ejecting ink droplets through nozzles. An inkjet recording device generally includes an inkjet head (droplet ejecting head) having a plurality of nozzles and an ink cartridge storing ink and connected to the inkjet head. When ink droplets are ejected from the plurality of nozzles of the inkjet head and ink is consumed, additional ink is supplied from the ink cartridge to the inkjet head.

In such an inkjet recording device, air sometimes enters a channel that connects the inkjet head with the ink cartridge, from the outside, during an exchange operation of the ink cartridge and the like. If such air (air bubble) flows together with ink to reach the inkjet head, poor ink ejection at the nozzles may be caused. Accordingly, an inkjet recording device has been proposed in which ink is sucked through nozzles of an inkjet head with a suction pump or the like, thereby discharging an air bubble existing within an ink supply channel at the upstream side of the inkjet head through the nozzles together with ink.

For example, Japanese Patent Application Publication No. 2005-199600 discloses an inkjet recording device which has a damper chamber (liquid storing chamber) between an inkjet head and an ink cartridge for absorbing pressure fluctuations of ink. When a certain amount of an air bubble is stored in the damper chamber, a suction pump sucks ink through nozzles to discharge, together with ink, the air bubble in the damper chamber located at the upstream side of the inkjet head through the nozzles.

SUMMARY

However, in the above-described inkjet recording device disclosed in Japanese Patent Application Publication No. 2005-199600, a strong suction force is required in order to discharge the air bubble in the damper chamber located at the upstream side of the inkjet head through the nozzles of the inkjet head, which considerably increases the amount of ink discharged through the nozzles together with the air bubble. In order to prevent such a problem, it is conceivable to adopt a channel structure where an air bubble in the damper chamber can easily move to the inkjet head. With this channel structure, however, an air bubble in the damper chamber moves to the inkjet head with a flow of ink flowing from the damper chamber to the inkjet head when ink is ejected through the nozzles for recording on a recording medium.

Then, this air bubble stays within the inkjet head, which may cause poor ink ejection (ejection malfunction).

In view of the foregoing, it is an object of the invention to provide a droplet ejecting device having a liquid supplying channel for supplying a droplet ejecting head having nozzles with liquid, the droplet ejecting device being capable of easily discharging an air bubble in the liquid supplying channel at the upstream side of the droplet ejecting head through the nozzles.

In order to attain the above and other objects, the invention provides a droplet ejecting device. The droplet ejecting device includes a droplet ejecting head, a channel member, a cap member, and a cap drive section. The droplet ejecting head has a droplet ejecting surface formed with droplet ejecting openings that eject liquid droplets. The channel member is configured to be tilted together with the droplet ejecting head. The channel member is formed with a liquid supplying channel including a liquid storing chamber and a communication channel in communication with each other via a connection section. The liquid storing chamber is in communication with the droplet ejecting head via the communication channel. The cap member is configured to be movable between: a standby position spaced away from the droplet ejecting surface; and a capping position at which the cap member is in close contact with the droplet ejecting surface and covers the droplet ejecting openings. The cap drive section drives the cap member to move between the standby position and the capping position. When the cap drive section drives the cap member to move to the capping position, the cap member presses the droplet ejecting head, and the channel member is tilted together with the droplet ejecting head in such a manner that the connection section is located at a position higher than the liquid storing chamber when the droplet ejecting device is placed in an orientation in which the droplet ejecting device is intended to be used.

BRIEF DESCRIPTION OF THE DRAWINGS

Embodiments in accordance with the invention will be described in detail with reference to the following figures wherein.

DETAILED DESCRIPTION

A droplet ejecting device according to an embodiment of the invention will be described while referring to FIGS. 1 through 11. The droplet ejecting device of the embodiment is applied to a printer that records (prints) desired texts and images on recording paper by ejecting ink droplets on recording paper from an inkjet head.

Figure 1:
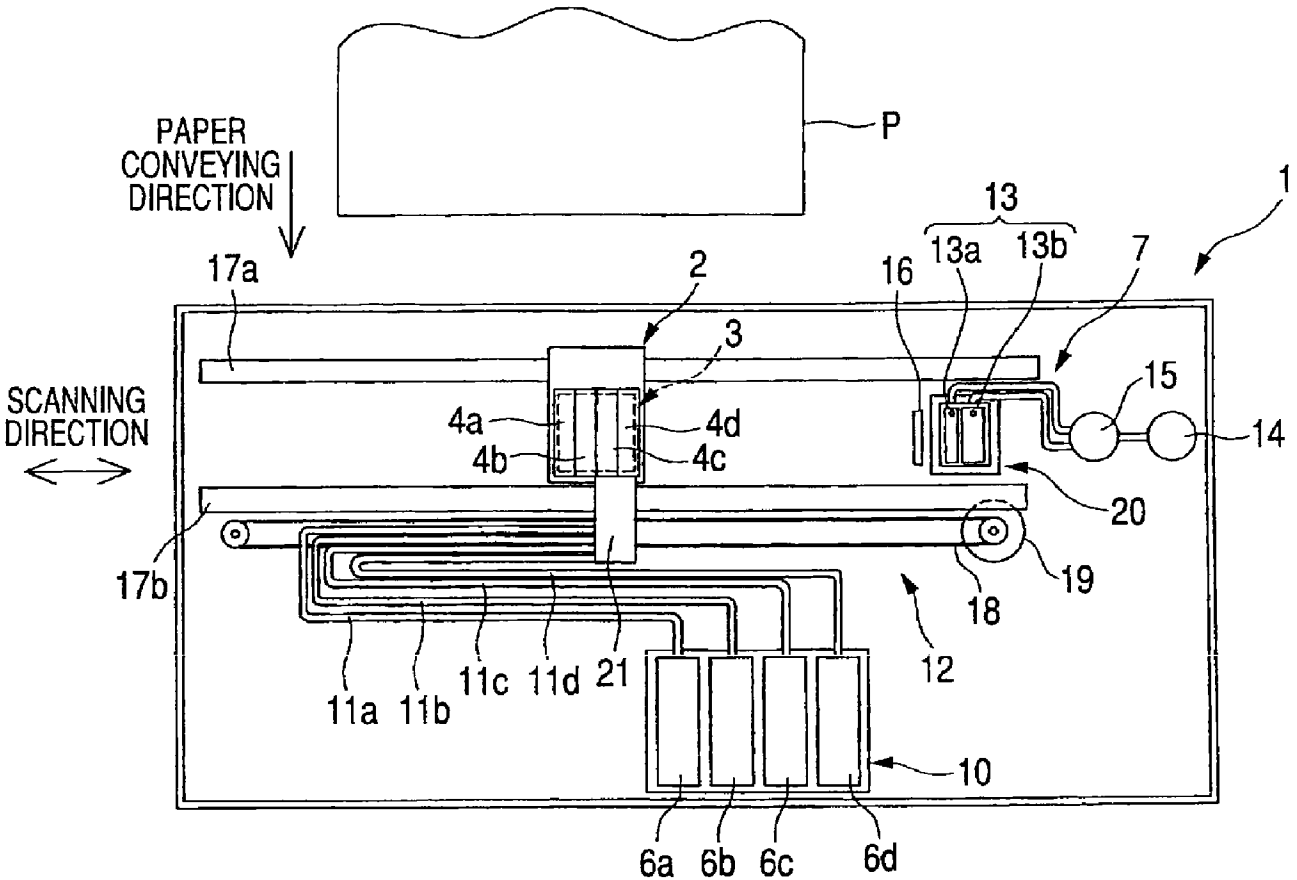
FIG. 1 is a plan view schematically showing the overall configuration of a printer according to an embodiment of the invention.

FIG. 1 is a plan view schematically showing the overall configuration of a printer 1 according to the embodiment. As shown in FIG. 1, the printer 1 (droplet ejecting device) includes a carriage 2 configured to be movable reciprocatingly in one direction (scanning direction), an inkjet head 3 (droplet ejecting head) and subsidiary tanks 4*a*-4*d* (channel member) both mounted on the carriage 2, ink cartridges 6*a*-6*d* that store ink, a maintenance mechanism 7 that recovers a droplet ejection performance when the droplet ejection performance is deteriorated due to entering of air or the like, a control unit 8 (see FIG. 7) that controls various components of the printer 1, and the like.

The printer 1 includes two guide frames 17*a* and 17*b* (first and second guide members) that extend in a horizontal direction (the left-right direction in FIG. 1, a scanning direction). The two guide frames 17*a* and 17*b* are arranged with a space therebetween in a paper conveying direction perpendicular to the scanning direction. The carriage 2 is movably mounted on the two guide frames 17*a* and 17*b*. The carriage 2 (support member) is driven by a carriage drive mechanism 12 to move reciprocatingly in the scanning direction, while being guided by the two guide frames 17*a* and 17*b*. In the present embodiment, the carriage drive mechanism 12 (support-member drive mechanism) includes an endless belt 18 connected to the carriage 2 and a carriage drive motor 19 that drivingly moves the endless belt 18. When the endless belt 18 is driven to move by the carriage drive motor 19, the carriage 2 moves in the scanning direction (the left-right direction in FIG. 1) together with the endless belt 18.

The inkjet head 3 and the four subsidiary tanks 4 (4*a*-4*d*) are mounted on the carriage 2. Nozzles 40 (see FIG. 2) are provided on the lower surface (the surface at the far side of the drawing in FIG. 1) of the inkjet head 3. The inkjet head 3 moves reciprocatingly in the scanning direction together with the carriage 2, while ejecting ink droplets through the nozzles 40 on recording paper P that is conveyed in the paper conveying direction (the up-to-down direction in FIG. 1) by a paper conveying mechanism (not shown). In this way, desired texts, images, and the like are recorded on the recording paper P.

The four subsidiary tanks 4*a*-4*d* are juxtaposed in the scanning direction. A tube joint 21 is connected to the four subsidiary tanks 4*a*-4*d*. Flexible tubes 11*a*-11*d* are connected to the tube joint 21. The four subsidiary tanks 4*a*-4*d* are connected to the respective ones of the four ink cartridges 6*a*-6*d* via the respective ones of the flexible tubes 11*a*-11*d*.

The four ink cartridges 6*a*-6*d* store ink in four colors of black, yellow, cyan, and magenta, respectively. Each of the ink cartridges 6*a*-6*d* is detachably mounted on a holder 10. Ink in four colors stored in the four ink cartridges 6*a*-6*d* is temporarily stored in the subsidiary tanks 4*a*-4*d*, respectively, and is subsequently supplied to the inkjet head 3.

Although not shown in FIG. 1, the holder 10 is provided with a cartridge detecting sensor 95 (see FIG. 7) that detects whether the four ink cartridges 6*a*-6*d* are mounted on the holder 10. For example, the cartridge detecting sensor 95 is an optical sensor that includes a light emitting element and a light receiving element and that detects whether the ink cartridges 6*a*-6*d* are mounted on the holder 10 based on whether light emitted from the light emitting element is blocked by the ink cartridges 6*a*-6*d* mounted on the holder 10. Alternatively, the cartridge detecting sensor 95 may be a contact-type sensor that detects that the ink cartridges 6*a*-6*d* are mounted on the holder 10 when a contact point at the holder 10 side and a contact point at the ink cartridge 6*a*-6*d* side are in contact with each other and the both contact points are in a conduction state.

The maintenance mechanism 7 is located at a position within a reciprocating range of the carriage 2 in the scanning direction, the position being outside (the right side in FIG. 1) of a printing region in confrontation with the recording paper P (hereinafter, the position is referred to as "maintenance position"). The maintenance mechanism 7 includes a cap member 13, a suction pump 14, a wiper 16, and the like. The cap member 13 is configured to be in close contact with a droplet ejecting surface 3*a* (the lower surface, see FIG. 3) of the inkjet head 3. The suction pump 14 (suction section) is connected to the cap member 13. The wiper 16 wipes off ink adhering to the lower surface of the inkjet head 3 (the droplet ejecting surface 3*a* on which droplet ejecting openings of a plurality of nozzles 40 are arranged, see FIGS. 2 and 3).

The cap member 13 confronts the lower surface of the inkjet head 3 (the droplet ejecting surface 3*a*) when the carriage 2 is moved to the maintenance position for recovering the droplet ejection performance of the inkjet head 3. Further, the cap member 13 is driven to move upward (the near side of the drawing in FIG. 1) by a cap drive mechanism 20 to be in close contact with the droplet ejecting surface 3*a* of the inkjet head 3, thereby covering the droplet ejecting openings of the plurality of nozzles 40 arranged on the droplet ejecting surface 3*a*. The configuration of the cap member 13 and the cap drive mechanism 20 will be described in greater detail later.

The cap member 13 is connected to the suction pump 14 via a switching unit 15. When the suction pump 14 is operated in a state where the cap member 13 covers the nozzles 40 arranged on the lower surface of the inkjet head 3, ink is sucked through the nozzles 40 and discharged. With this operation, it is possible to discharge ink in the nozzles 40 with increased viscosity due to drying, and to discharge an air bubble that has entered the inkjet head 3 through the nozzles 40. In addition, the inkjet head 3 is configured to move, together with the carriage 2, in the scanning direction relative to the wiper 16, in a state where the cap member 13 is spaced away from the droplet ejecting surface 3*a* of the inkjet head 3 after ink is discharged by suction through the nozzles 40. With this operation, ink adhering to the droplet ejecting surface 3*a* of the inkjet head 3 is wiped off by the wiper 16.

In the present embodiment, as shown in FIG. 1, the cap member 13 includes a first cap section 13*a* for covering the nozzles 40 that eject black ink and a second cap section 13*b* for covering the nozzles 40 that eject ink in three colors (yellow ink, magenta ink, and cyan ink). The first cap section 13*a* and the second cap section 13*b* are separated from each other. In addition, the first cap section 13*a* and the second cap section 13*b* are connected to the switching unit 15 via tubes, respectively. The switching unit 15 is connected to the suction pump 14. The switching unit 15 includes valves (not shown) controlled by signals from the control unit 8 (see FIG. 7) and the like, and is for switching the operating section of the suction pump 14. Accordingly, the switching unit 15 can switch the operating section of the suction pump 14 between the first cap section 13*a* and the second cap section 13*b*, thereby selecting either the nozzles 40 that eject black ink or the nozzles 40 that eject color ink for ink suction.

Figure 2:
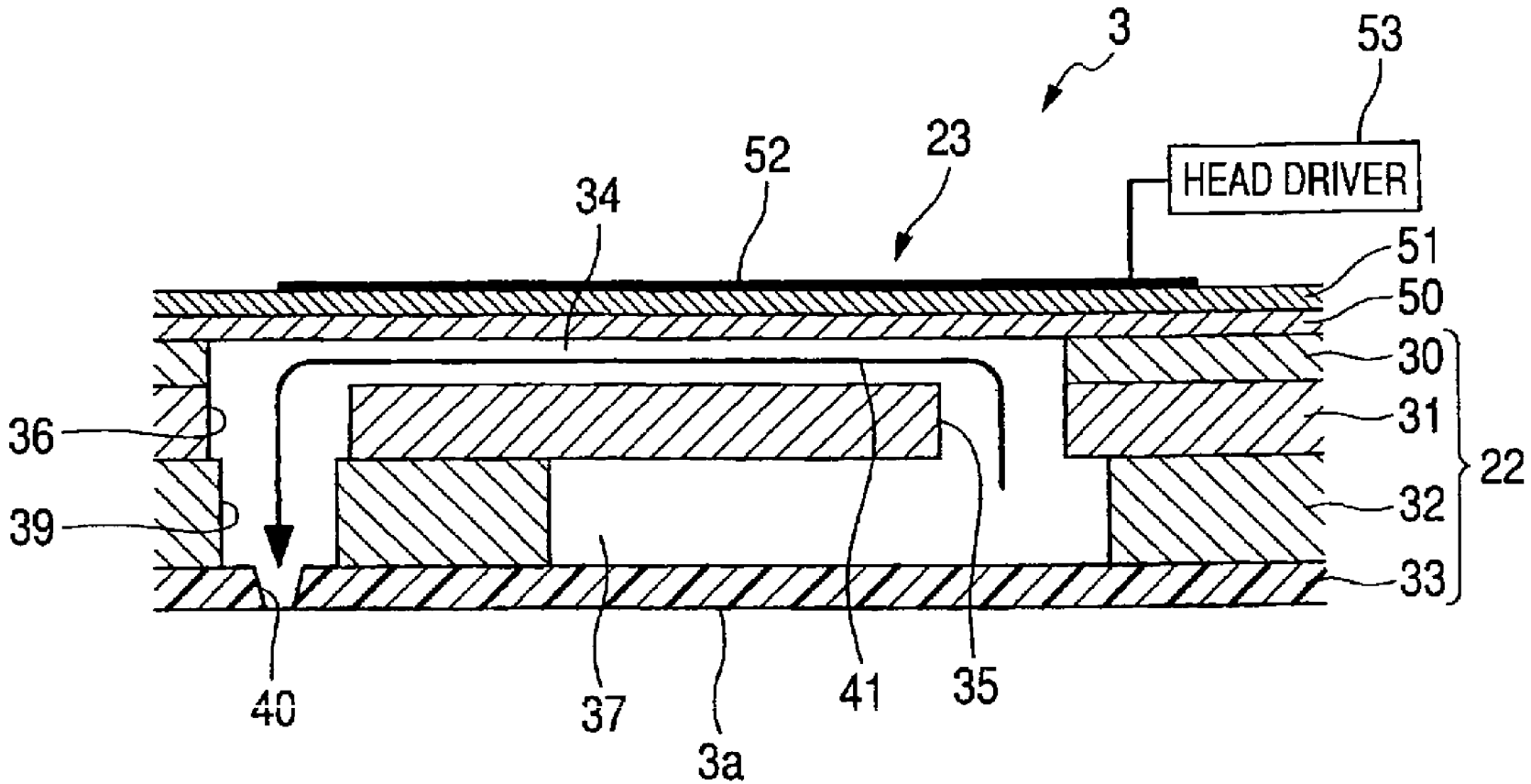
FIG. 2 is a vertical cross-sectional view of a part of an inkjet head provided in the printer shown in FIG. 1.

Next, the inkjet head 3 will be described. FIG. 2 is a vertical cross-sectional view of a part of the inkjet head 3. As shown in FIG. 2, the inkjet head 3 includes a channel unit 22 and a piezoelectric actuator 23. The channel unit 22 is formed with an ink channel including the nozzle 40 and a pressure chamber 34. The piezoelectric actuator 23 applies pressure to ink in the pressure chamber 34, thereby ejecting ink through the nozzle 40 of the channel unit 22.

The channel unit 22 includes a cavity plate 30, a base plate 31, a manifold plate 32, and a nozzle plate 33. The cavity plate 30, the base plate 31, and the manifold plate 32 are made of metal material such as stainless steel. The nozzle plate 33 is made of insulating material (for example, polymer synthetic resin material such as polyimide) These four plates 30 through 33 are bonded with each other in a layered state.

The cavity plate 30 is formed with the pressure chamber 34. Note that a plurality of pressure chambers 34 is arranged in the direction perpendicular to the surface of the drawing of FIG. 2. The base plate 31 is formed with communication holes 35 and 36 in communication with the respective ones of the pressure chambers 34. The manifold plate 32 is formed with a manifold 37 in communication with the plurality of pressure chambers 34 via the communication holes 35. In addition, the manifold plate 32 is formed with communication holes 39 in communication with the communication holes 36. The nozzle plate 33 is formed with the plurality of nozzles 40. The lower surface of the nozzle plate 33 serves as the droplet ejecting surface 3*a* on which the droplet ejecting openings of the plurality of nozzles 40 are formed. The plurality of nozzles 40 is arranged in the direction perpendicular to the surface of the drawing of FIG. 2. The plurality of nozzles 40 is provided in one-to-one correspondence with the plurality of pressure chambers 34.

With this configuration, as shown in FIG. 2, a plurality of individual ink channels 41 is formed within the channel unit 22, each of the plurality of individual ink channels 41 being formed from the manifold 37 to the nozzle 40 via the pressure chamber 34.

The piezoelectric actuator 23 includes a metal-made vibration plate 50, a piezoelectric layer 51, and a plurality of individual electrodes 52. The vibration plate 50 is bonded with the upper surface of the channel unit 22 such that the vibration plate 50 covers the plurality of pressure chambers 34. The piezoelectric layer 51 is disposed on the upper surface of the vibration plate 50. The plurality of individual electrodes 52 is formed on the upper surface of the piezoelectric layer 51.

The metal-made vibration plate 50 is connected to a ground line of a head driver 53 and is always kept to a ground potential. The piezoelectric layer 51 is made of piezoelectric material including lead zirconate titanate (PZT) as the chief component, where the lead zirconate titanate is a solid solution of lead titanate and lead zirconate and is a ferroelectric substance. The piezoelectric layer 51 is arranged on the upper surface of the vibration plate 50, such that the piezoelectric layer 51 covers the plurality of pressure chambers 34. The plurality of individual electrodes 52 is arranged on the upper surface of the piezoelectric layer 51 in respective regions corresponding to the center portions of the plurality of pressure chambers 34. The head driver 53 supplies the plurality of individual electrodes 52 with either one of a ground potential and a predetermined driving potential different from the ground potential.

The operation of the piezoelectric actuator 23 during ink ejection will be described. In order to eject an ink droplet from one of the nozzles 40, the head driver 53 applies a driving potential to the individual electrode 52 corresponding to the pressure chamber 34 in communication with the nozzle 40. Then, a potential difference is generated between the individual electrode 52 to which the driving potential is applied and the vibration plate 50 kept to the ground potential, which generates an electric field through the piezoelectric layer 51 sandwiched between the individual electrode 52 and the vibration plate 50 in a direction parallel to the thickness direction. Here, if the polarization direction of the piezoelectric layer 51 is the same as the direction of the electric field, the piezoelectric layer 51 expands in the thickness direction and contracts in the surface direction. With this contraction deformation of the piezoelectric layer 51, a portion of the vibration plate 50 facing the pressure chamber 34 deforms such that the portion becomes convex toward the pressure chamber 34 side (unimorph deformation).

At this time, the volume of the pressure chamber 34 decreases. Thus, the pressure of ink in the pressure chamber 34 increases, and ink is ejected through the nozzle 40 in communication with the pressure chamber 34.

Next, supplemental descriptions will be given for the carriage 2 supporting the subsidiary tanks 4 and the inkjet head 3, prior to descriptions of the subsidiary tanks 4.

Figure 3:
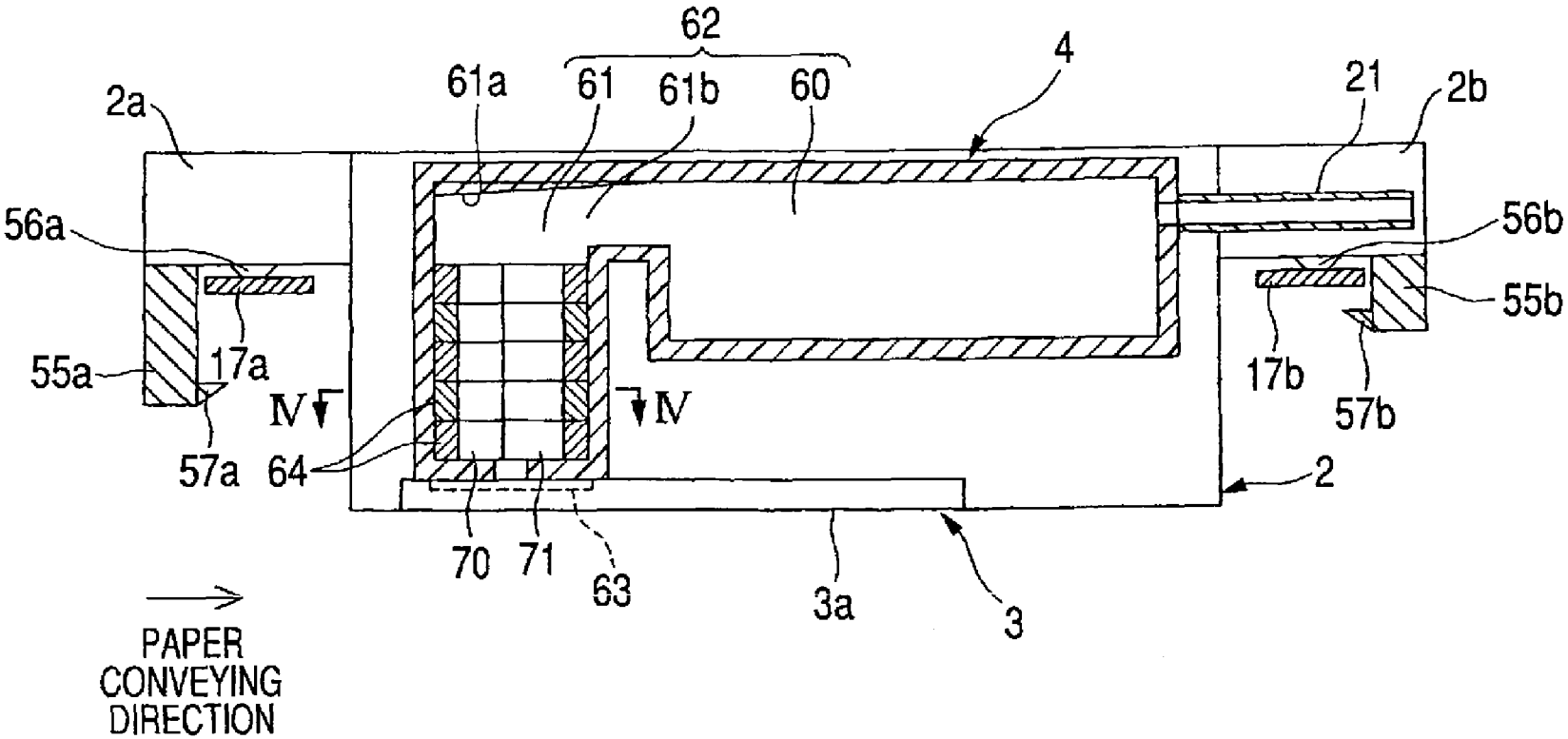
FIG. 3 is a cross-sectional view of a carriage on which the inkjet head and subsidiary tanks are mounted, in a vertical surface parallel to a paper conveying direction.

FIG. 3 is a cross-sectional view of the carriage 2 on which the inkjet head 3 and the subsidiary tanks 4 are mounted, in a vertical surface parallel to the paper conveying direction. The carriage 2 supports the inkjet head 3 and the subsidiary tanks 4. The carriage 2 is configured to be tilted (slanted) between a horizontal orientation in which the droplet ejecting surface 3*a* of the inkjet head 3 is parallel to the horizontal surface (the orientation shown in FIG. 3) and a slanted orientation slanted from the horizontal orientation.

The specific configuration for implementing the tilting operation of the carriage 2 will be described. As shown in FIG. 3, the carriage 2 has two end sections 2*a* and 2*b* with respect to the paper conveying direction (the left-right direction in FIG. 3). Two abutting sections 56*a* and 56*b* and two leg sections 55*a* and 55*b* are provided on the lower surfaces of the two end sections 2*a* and 2*b*. Here, the two leg sections 55*a* and 55*b* are located outside of the two abutting sections 56*a* and 56*b* in the paper conveying direction, respectively. In a state shown in FIG. 3, the two abutting sections 56*a* and 56*b* abut on the two guide frames 17*a* and 17*b*, respectively, extending in the scanning direction (the direction perpendicular to the drawing of FIG. 3) in parallel with each other. The two leg sections 55*a* and 55*b* extend downward from the lower surfaces of the two end sections 2*a* and 2*b*, respectively. The carriage 2 is movable in the scanning direction while the two abutting sections 56*a* and 56*b* abut on the two guide frames 17*a* and 17*b*, respectively. The position of the carriage 2 in the paper conveying direction is restricted by the two leg sections 55*a* and 55*b* and the two guide frames 17*a* and 17*b*. In this way, the carriage 2 is guided in the scanning direction by the two guide frames 17*a* and 17*b*.

Because the two abutting sections 56*a* and 56*b* of the carriage 2 merely abut on the two guide frames 17*a* and 17*b*, the carriage 2 is movable upward relative to the two guide frames 17*a* and 17*b*. However, engaging sections 57*a* and 57*b* are provided at the lower end sections of the two leg sections 55*a* and 55*b*, respectively. The engaging sections 57*a* and 57*b* engage the guide frames 17*a* and 17*b* when the carriage 2 moves upward and the abutting sections 56*a* and 56*b* are spaced away from the guide frames 17*a* and 17*b*, thereby restricting further upward movement of the carriage 2. That is, the carriage 2 is allowed to move upward by the lengths of the leg sections 55*a* and 55*b*.

In addition, the length of the leg section 55*a* located at the upstream side in the paper conveying direction (the left side in FIG. 3) is longer than the length of the leg section 55*b* located at the downstream side (the right side in FIG. 3). In other words, the distance between the abutting section 56*a* and the engaging section 57*a* in the vertical direction is larger than the distance between the abutting section 56*b* and the engaging section 57*b* in the vertical direction. Hence, the allowable upward moving amount of the carriage 2 (the end section 2*a* side or the upstream side of the carriage 2) relative to the guide frame 17*a* is larger than the allowable upward moving amount of the carriage 2 (the end section 2*b* side or the downstream side of the carriage 2) relative to the guide frame 17*b*. With the difference in these allowable upward moving amounts, the carriage 2 is capable of tilting relative to the horizontal orientation in such a manner that the upstream side in the paper conveying direction (the end section 2*a* side) is located at a position higher than the downstream side (the end section 2*b* side), together with the inkjet head 3 and the subsidiary tanks 4 mounted on the carriage 2 (see FIGS. 10 and 11).

Next, the structure of the subsidiary tank 4 (channel member) will be described. Because the structures of the four subsidiary tanks 4*a*-4*d* storing ink in the respective four colors are basically identical, one of the subsidiary tanks will be described below.

The subsidiary tank 4 is made of synthetic resin material or the like. As shown in FIG. 3, the subsidiary tank 4 is formed with an ink supplying channel 62 (liquid supplying channel) including an ink storing chamber 60 (liquid storing chamber) and a communication channel 61. The ink storing chamber 60 extends in a horizontal direction. The communication channel 61 is in communication with both the upper section of the ink storing chamber 60 and the inkjet head 3.

The ink storing chamber 60 extends horizontally in the paper conveying direction. The ink storing chamber 60 is in communication with the ink cartridge 6 (see FIG. 1) via the tube 11 connected to the tube joint 21. The ink storing chamber 60 temporarily stores ink supplied from the ink cartridge 6.

The communication channel 61 is formed in a part of the subsidiary tank 4 at the upstream side of the ink storing chamber 60 in the paper conveying direction (the left side in FIG. 3). The communication channel 61 extends in the up-down direction. The upper end section of the communication channel 61 is located at substantially the same height as the outlet of the ink storing chamber 60. The upper end section of the communication channel 61 is in communication with the upper section (the outlet) of the ink storing chamber 60. Further, the lower end section of the communication channel 61 is connected to the inkjet head 3 (a part of the inkjet head 3 not shown in FIG. 2). A filter 63 is provided at a connection opening of the inkjet head 3 connected to the subsidiary tank 4 (the lower end section of the communication channel 61). The filter 63 is for removing foreign matters and the like that have entered ink flowing from the subsidiary tank 4 toward the inkjet head 3.

Ink supplied from the ink cartridge 6 to the subsidiary tank 4 via the tube 11 is temporarily stored in the ink storing chamber 60, and then horizontally flows out of the outlet of the ink storing chamber 60 toward the upstream side in the paper conveying direction (toward the upper end section of the communication channel 61). Then, ink flows downward within the communication channel 61 to pass through the filter 63, and is supplied to the inkjet head 3.

As shown in FIG. 3, a ceiling surface 61*a* is provided at a connection section 61*b* between the ink storing chamber 60 and the communication channel 61 (the upper end section of the communication channel 61). When the subsidiary tank 4 is in the horizontal orientation, the ceiling surface 61*a* is sloped upward toward the ink storing chamber 60 side. Hence, a force acts on an air bubble in the subsidiary tank 4, the force being caused by buoyancy and being in the direction along the ceiling surface 61*a* (sloped surface) toward the ink storing chamber 60 side. Thus, an air bubble is not likely to move to the communication channel 61 and is likely to stay in the ink storing chamber 60 side (see FIG. 8). Accordingly, this structure suppresses the movement of an air bubble in the ink storing chamber 60 toward the inkjet head 3 with a flow of ink flowing from the ink storing chamber 60 to the inkjet head 3 via the communication channel 61, when ink is ejected (consumed) through the nozzles 40 of the inkjet head 3 for printing images and the like on the recording paper P.

In the present embodiment, a plurality of plate-shaped flow adjusting members 64 is provided within the communication channel 61 of the subsidiary tank 4. The plurality of flow adjusting members 64 is for allowing an air bubble in the subsidiary tank 4 to easily move to the inkjet head 3 when ink is sucked through the nozzles 40 by the suction pump 14 to discharge the air bubble in the subsidiary tank 4. In addition, the plurality of flow adjusting members 64 is for adjusting a flow of ink and an air bubble so that an air bubble does not move to the inkjet head 3 when ink is ejected through the nozzles 40 for recording images and the like on the recording paper P, by narrowing part of the communication channel 61.

As shown in FIG. 3, each of the flow adjusting members 64 is a plate-shaped member made of synthetic resin material or the like. The plurality (for example, five) of flow adjusting members 64 is juxtaposed in the up-down direction (the direction in which the communication channel 61 extends, and hereinafter referred to as "channel extending direction") from a point partway in the communication channel 61 (a channel section slightly below the connection section 61*b* between the communication channel 61 and the ink storing chamber 60) to the bottom surface (the connection section between the communication channel 61 and the inkjet head 3). Each of the flow adjusting members 64 having a plate shape is arranged in such a manner that the surface direction is perpendicular to the channel extending direction of the communication channel 61. In addition, the confronting surfaces of the adjacent flow adjusting members 64 are in contact with each other.

In the present embodiment, among the plurality of flow adjusting members 64 juxtaposed in the up-down direction (vertical direction), the flow adjusting member 64 located at the lowest position is disposed in contact with the bottom surface of the communication channel 61. Because the surface tension acts between the flow adjusting member 64 located at the lowest position and the bottom surface of the communication channel 61, the plurality of flow adjusting members 64 does not move within the communication channel 61 due to ink flow that flows downward in the communication channel 61.

However, the configuration for restricting displacement (movement) of the flow adjusting members 64 in the up-down direction is not limited to the above-described configuration. For example, the displacement of the flow adjusting members 64 in the up-down direction may be restricted by putting the flow adjusting members 64 into the communication channel 61 by press fit in a slightly compressed state, where the flow adjusting members 64 are made of relatively soft material such as synthetic resin material. Alternatively, each of the flow adjusting members 64 may be provided with an engaging section that engages the inner surface of the communication channel 61, and the displacement of the flow adjusting members 64 in the up-down direction may be restricted by this engagement. Note that if the displacement of the flow adjusting members 64 in the up-down direction is restricted with the above-described modified examples, it is not necessary that the flow adjusting members 64 be in contact with the bottom surface of the communication channel 61, and the plurality of flow adjusting members 64 may be arranged at a position partway in the communication channel 61.

Figure 4:
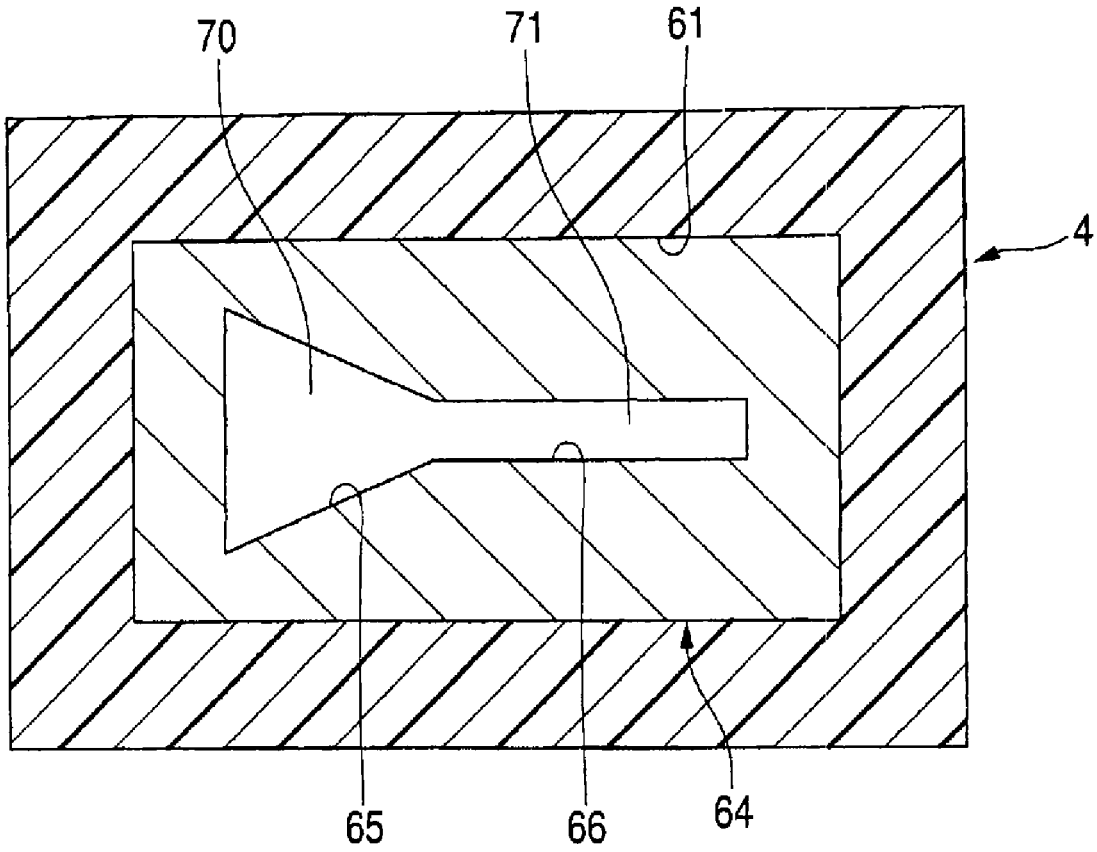
FIG. 4 is a cross-sectional view taken along a line IV-IV in FIG. 3.

FIG. 4 is a horizontal cross-sectional view taken along a line IV-IV in FIG. 3. As shown in FIG. 4, the channel cross-section (cross-section in the horizontal direction) of the communication channel 61 has a rectangular shape. The flow adjusting members 64 are arranged within the communication channel 61 in an orientation perpendicular to the channel extending direction, and have horizontal shapes of a rectangle in order to fit the shape of the communication channel 61. Each of the flow adjusting members 64 is formed with an elongated hole 66 extending in the lengthwise direction of the rectangle and with a triangular hole 65 having a shape that widens from one end of the elongated hole 66. Here, the hole area (the area of the hole in the horizontal cross-section in FIG. 4) of the triangular hole 65 (first through-hole) is larger than the hole area of the elongated hole 66 (second through-hole). With this configuration, each of the flow adjusting members 64 is formed with a low-resistance channel 70 and a high-resistance channel 71. The low-resistance channel 70 is formed by the triangular hole 65 having a large hole area, and has a small flow resistance (channel resistance). The high-resistance channel 71 is formed by the elongated hole 66 having a small hole area, and is in communication with the low-resistance channel 70 and has a larger flow resistance than the low-resistance channel 70. The high-resistance channel 71 is formed integrally with the low-resistance channel 70.

As shown in FIG. 3, the outlet of the ink storing chamber 60 extending in the horizontal direction is in communication with the upper end section of the communication channel 61. Hence, a large part of ink flowing into the communication channel 61 from the ink storing chamber 60 flows downward within the communication channel 61 along the side wall at the far side as viewed from the ink storing chamber 60 side (the left side in FIG. 3). Accordingly, in the communication channel 61, the flow velocity (flow rate) is especially large in a region adjacent to the side wall at the opposite side from the ink storing chamber 60 (the side far from the ink storing chamber 60).

In addition, as shown in FIGS. 3 and 4, the low-resistance channel 70 (the triangular hole 65) of each of the flow adjusting members 64 is located in a region opposite to the ink storing chamber 60 in the communication channel 61 (the left side in FIG. 3). On the other hand, the high-resistance channel 71 (the elongated hole 66) extends along a horizontal surface perpendicular to the channel extending direction of the communication channel 61, such that the high-resistance channel 71 approaches the ink storing chamber 60 from the low-resistance channel 70. Hence, the flow velocity of ink is higher in a region where the low-resistance channel 70 is located than a region where the high-resistance channel 71 is located.

Next, the cap member 13 and the cap drive mechanism 20 will be described. The cap member 13 is attached to the droplet ejecting surface 3*a* of the inkjet head 3 when ink is discharged by suction through the nozzles 40. The cap drive mechanism 20 drives the cap member 13 to move up and down.

Figure 5:
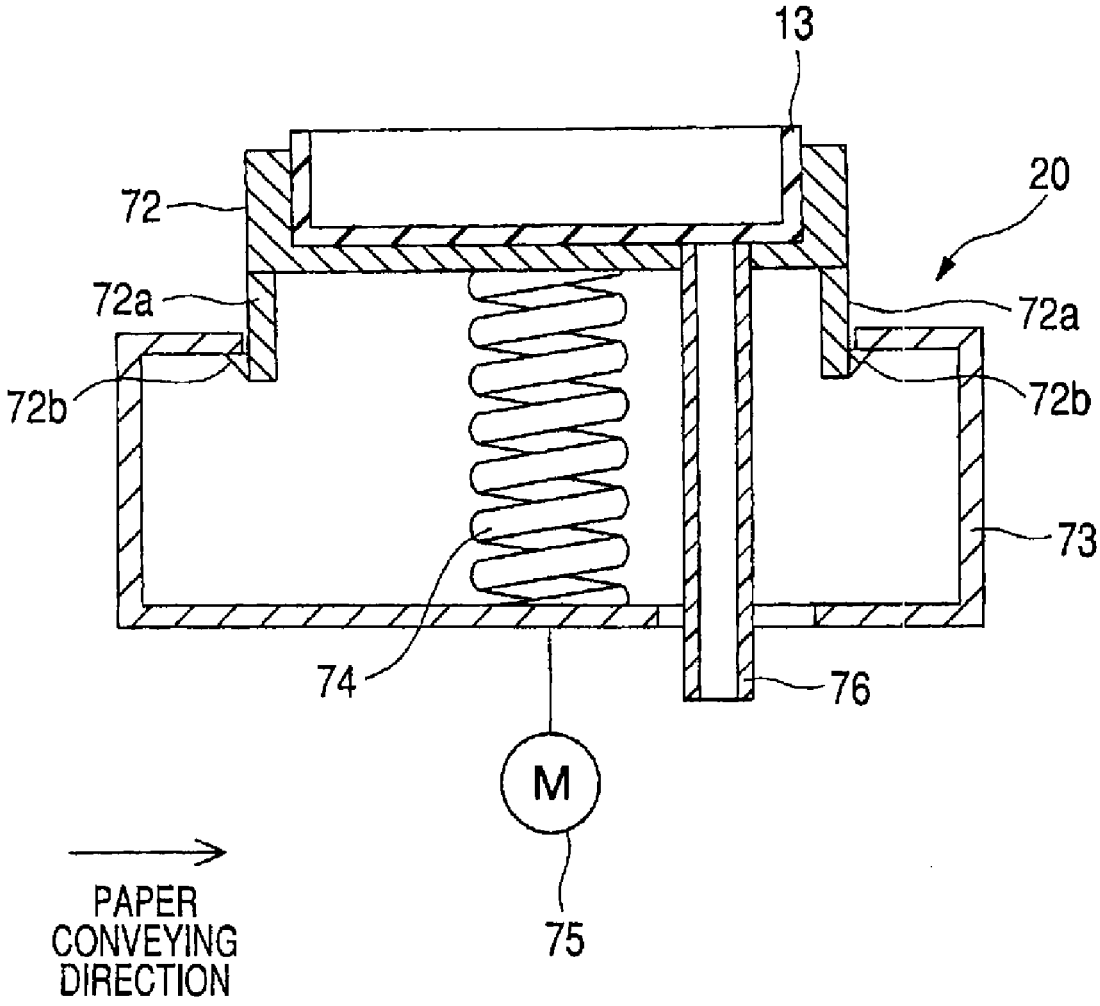
FIG. 5 is a vertical cross-sectional view of a cap member and a cap drive mechanism in a standby state.
Figure 6:
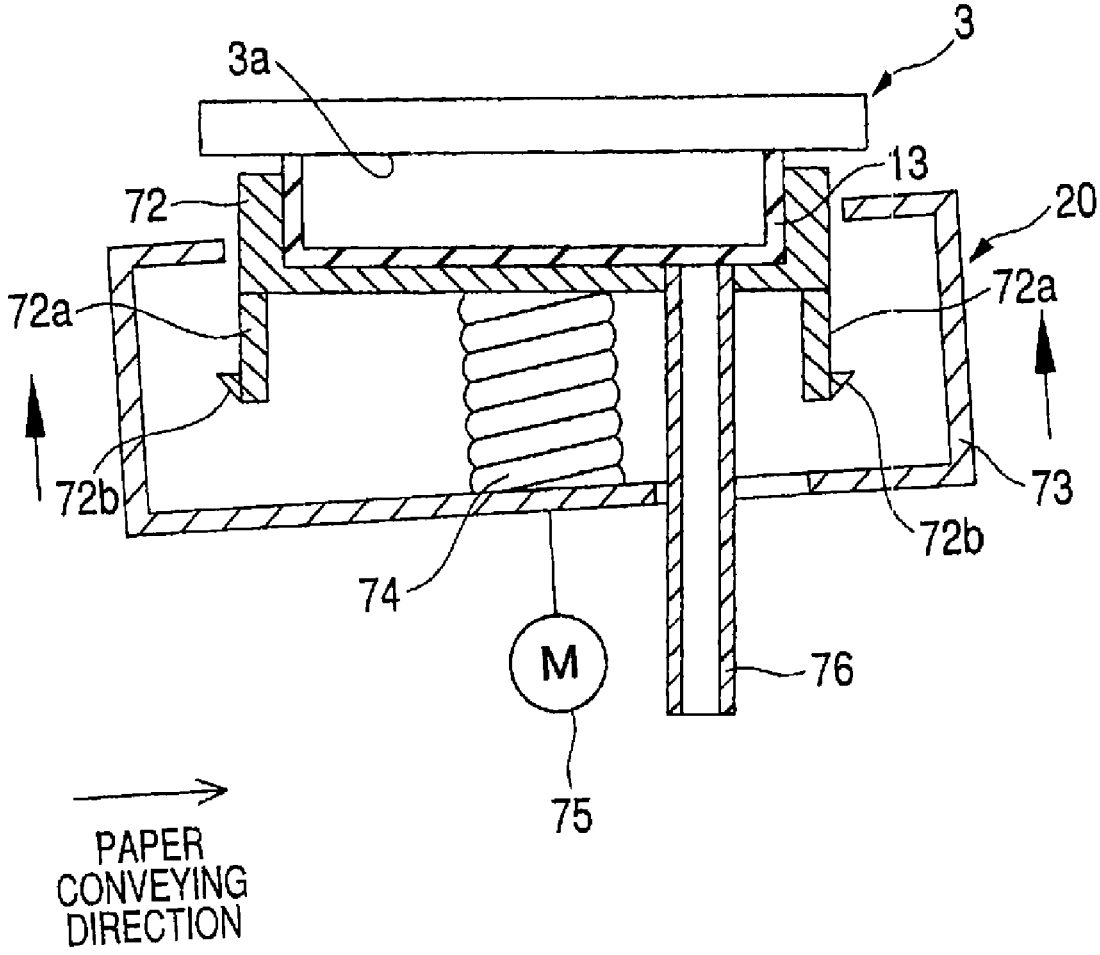
FIG. 6 is a vertical cross-sectional view of the cap member and the cap drive mechanism in a capping state.

FIG. 5 is a vertical cross-sectional view of the cap member 13 and the cap drive mechanism 20 in a standby state. FIG. 6 is a vertical cross-sectional view of the cap member 13 and the cap drive mechanism 20 in a capping state. The cap member 13 is made of a flexible material such as rubber and synthetic resin. The bottom section of the cap member 13 is connected to the suction pump 14 (see FIG. 1) via a tube 76. The cap member 13 is movable between a standby position spaced away from the droplet ejecting surface 3*a* of the inkjet head 3 (the position shown in FIG. 5) and a capping position in close contact with the droplet ejecting surface 3*a* for covering the droplet ejecting openings of the nozzles 40 (the position shown in FIG. 6).

The cap drive mechanism 20 drives the cap member 13 to move between the standby position and the capping position. The cap drive mechanism 20 includes a cap holder 72, a lift holder 73, a spring 74, a cap drive motor 75, and the like. The cap holder 72 holds the cap member 13. The lift holder 73 is provided at the lower side of the cap holder 72 to be movable in the up-down direction. The spring 74 is disposed within the lift holder 73 for urging the cap holder 72 upward. The cap drive motor 75 drives the lift holder 73 to move upward.

The cap holder 72 has two leg sections 72*a* that protrude downward. Further, engaging sections 72*b* capable of engaging the lift holder 73 are provided at the lower end sections of the respective ones of the two leg sections 72*a*. Thus, as shown in FIG. 5, when the lift holder 73 is not driven to move upward by the cap drive motor 75, the cap holder 72 is urged upward by the spring 74. However, the left and right engaging sections 72*b* of the cap holder 72 engage the top sections of the lift holder 73, which restricts further upward movement of the cap holder 72. In this state, the cap member 13 held by the cap holder 72 is in a horizontal orientation and in a standby state (standby position).

As shown in FIG. 6, when the lift holder 73 is driven to move upward by the cap drive motor 75 in a state where the carriage 2 is moved to the maintenance position outside of the printing region and where the droplet ejecting surface 3*a* of the inkjet head 3 is in confrontation with the cap member 13, the cap holder 72 supported by the lift holder 73 via the spring 74 also moves upward. Then, the cap member 13 held by the cap holder 72 is attached closely to the droplet ejecting surface 3*a* of the inkjet head 3 and covers the droplet ejecting openings of the plurality of nozzles 40 (capping position).

Here, as shown in FIG. 6, when the lift holder 73 is driven to move upward, the engagement between the engaging sections 72*b* of the cap holder 72 and the lift holder 73 is released. In this state, the cap holder 72 is supported only by the spring 74. Hence, the cap holder 72 is capable of tilting freely with respect to the horizontal direction.

As described above with reference to FIG. 3, the carriage 2 has different allowable upward moving amounts relative to the two guide frames 17*a* and 17*b* that are arranged with a space therebetween in the paper conveying direction (the direction in which ink flows from the ink storing chamber 60 to the communication channel 61). With this structure, the carriage 2 is capable of tilting such that the upstream side of the carriage 2 in the paper conveying direction is located at a position higher than the downstream side. Accordingly, as shown in FIG. 6, when the lift holder 73 is driven to move upward by the cap drive motor 75 in a state where the cap member 13 is attached closely to the droplet ejecting surface 3*a* of the inkjet head 3, the cap member 13 urges the droplet ejecting surface 3*a* of the inkjet head 3 upward while tilting its orientation with respect to the horizontal direction. With this operation, the inkjet head 3 and the subsidiary tanks 4 supported by the carriage 2 are tilted from the horizontal orientation, such that the upstream side in the paper conveying direction is located at a position higher than the downstream side.

Figure 10:
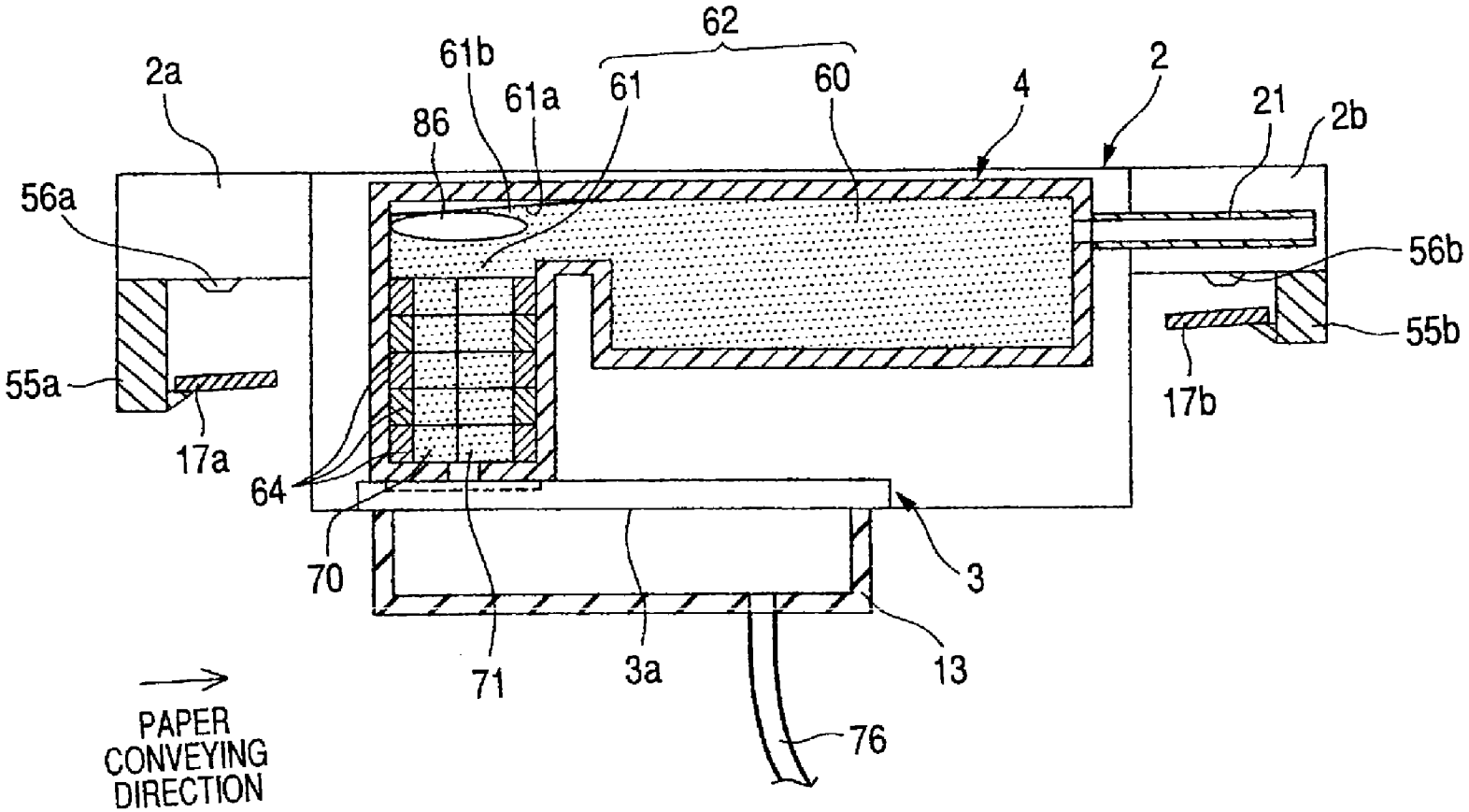
FIG. 10 is a vertical cross-sectional view of the carriage in a state where the carriage is driven to be tilted by the cap member.
Figure 11:
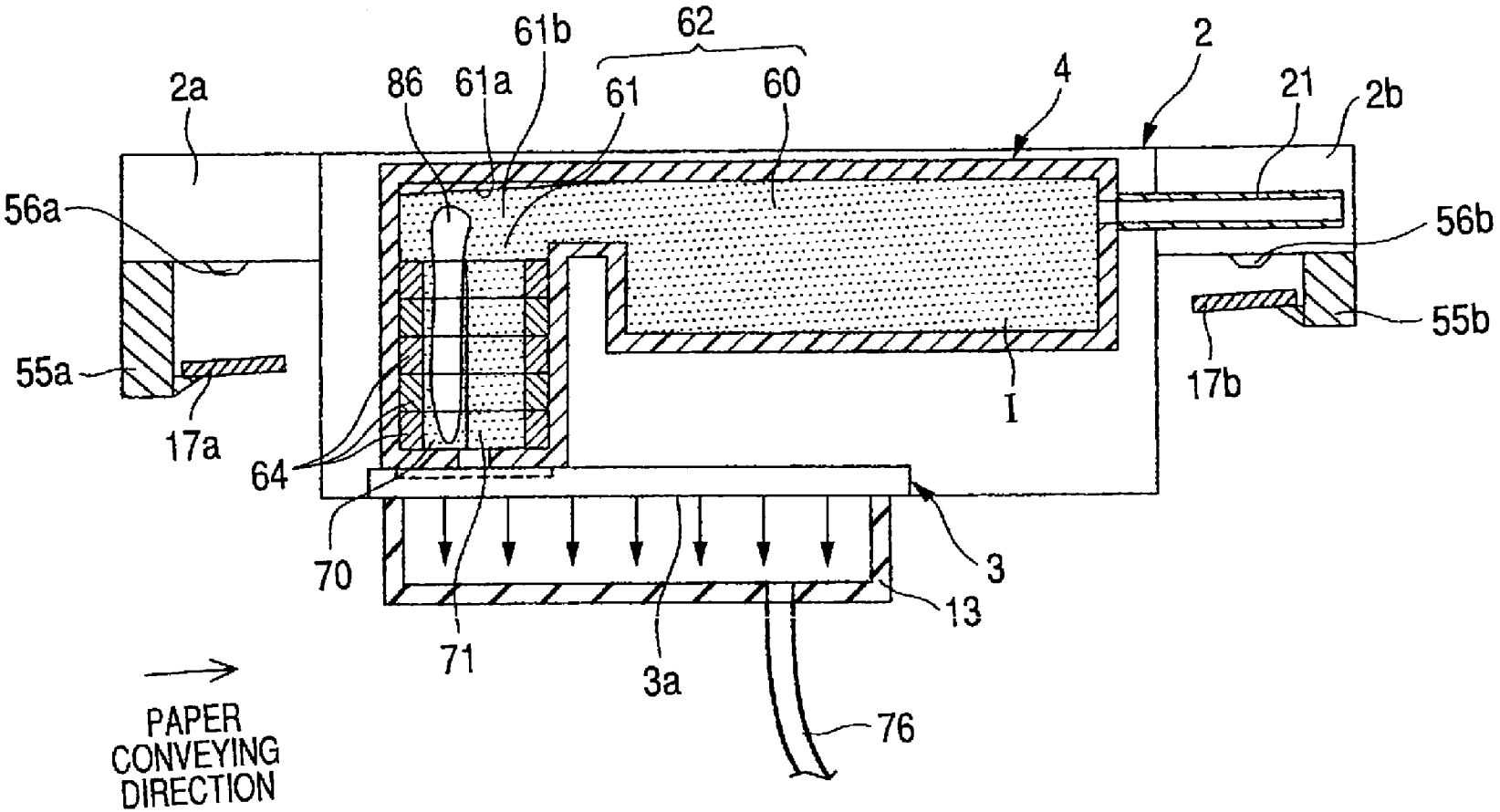
FIG. 11 is a vertical cross-sectional view of the carriage in a state where ink is being discharged by suction.

At this time, in the ink supplying channel 62 in the subsidiary tank 4, the connection section 61*b* between the ink storing chamber 60 and the communication channel 61 (the upper end section of the communication channel 61) is located at a position higher than the ink storing chamber 60 at the upstream side in the ink flowing direction (see FIGS. 10 and 11). Thus, an air bubble in the ink storing chamber 60 moves to the communication channel 61 at the downstream side due to buoyancy. Subsequently, the air bubble is likely to move to the inkjet head 3 when ink is sucked through the nozzles 40 by the suction pump 14.

In the present embodiment, as shown in FIG. 1, the carriage drive mechanism 12 for driving the carriage 2 in the scanning direction has a belt-drive structure including the endless belt 18 connected to the carriage 2 and the carriage drive motor 19 that drives the endless belt 18. Hence, when the inkjet head 3 is pressed upward by the cap member 13, the endless belt 18 deforms and the carriage 2 supporting the inkjet head 3 can move upward relatively easily. In addition, the endless belt 18 is connected to the end section of the carriage 2 at the downstream side in the paper conveying direction (i.e., the part opposite to the connection section 61*b* with respect to the ink storing chamber 60). Further, the upward moving amount of the carriage 2 when tilted is smaller at the downstream side in the paper conveying direction than at the upstream side. That is, because the endless belt 18 for driving the carriage 2 is connected to the part of which the upward moving amount is small when the carriage 2 is tilted, the stretching amount (the amount of extension) of the endless belt 18 can be made small.

Figure 7:
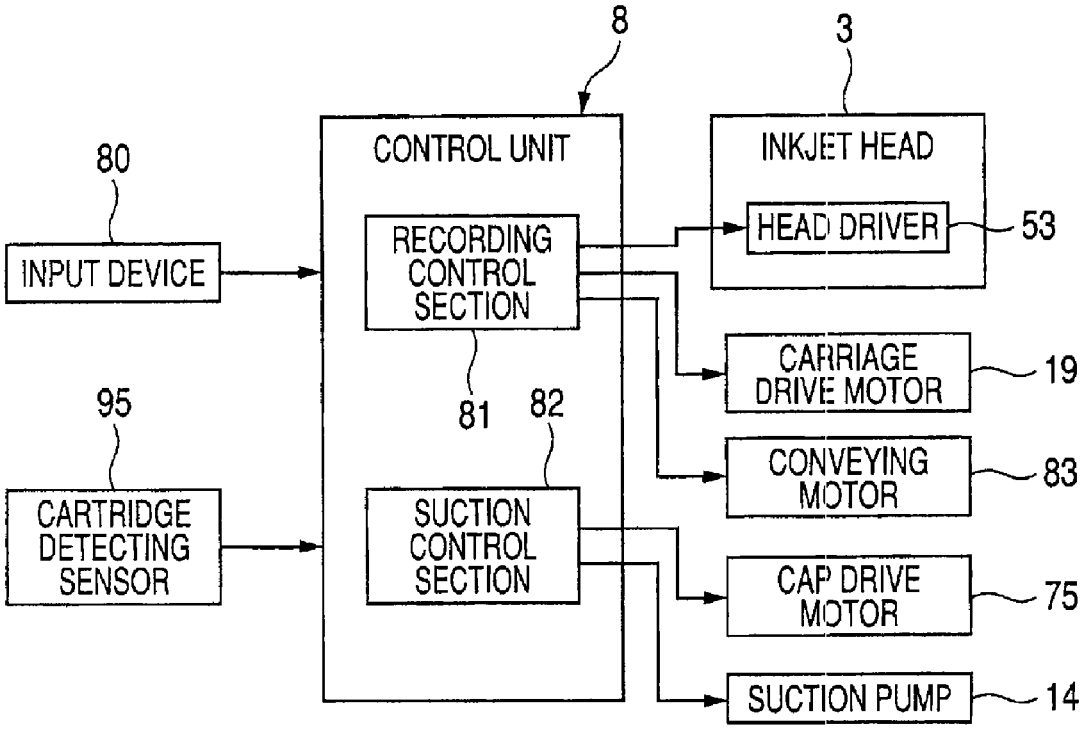
FIG. 7 is a block diagram schematically showing the electrical configuration of the printer.

Next, a control unit 8 performing the overall controls of the printer 1 will be described. FIG. 7 is a block diagram showing the electrical configuration of the printer 1. The control unit 8 shown in FIG. 7 includes a CPU (Central Processing Unit), a ROM (Read Only Memory) that stores various programs, data, etc. for controlling the overall operations of the printer 1, a RAM (Random Access Memory) that temporarily stores data etc. processed by the CPU, and the like.

The control unit 8 includes a recording control section 81 and a suction control section 82. The recording control section 81 controls the carriage drive motor 19 that drives the carriage 2 to move reciprocatingly, the head driver 53 of the inkjet head 3, a conveying motor 83 of the paper conveying mechanism (not shown) that conveys the recording paper P, and the like based on data inputted via an input device 80 such as a personal computer, thereby performing recording of images and the like on the recording paper P. The suction control section 82 controls various sections of the maintenance mechanism 7 including the cap drive motor 75 that drives the cap member 13 to move up and down, the suction pump 14, and the like to perform an ink suction operation for sucking ink through the plurality of nozzles 40 of the inkjet head 3.

Next, the behavior of an air bubble in the subsidiary tank 4 during the ink suction operation will be described while referring to FIGS. 8 through 11. The ink suction operation is performed when ink droplets are ejected through the nozzles 40 for printing images and the like on the recording paper P, and when ink is discharged through the nozzles 40 by suction of the suction pump 14 for recovering the droplet ejection performance of the inkjet head 3.

1) Droplet Ejection for Printing Images

Figure 8:
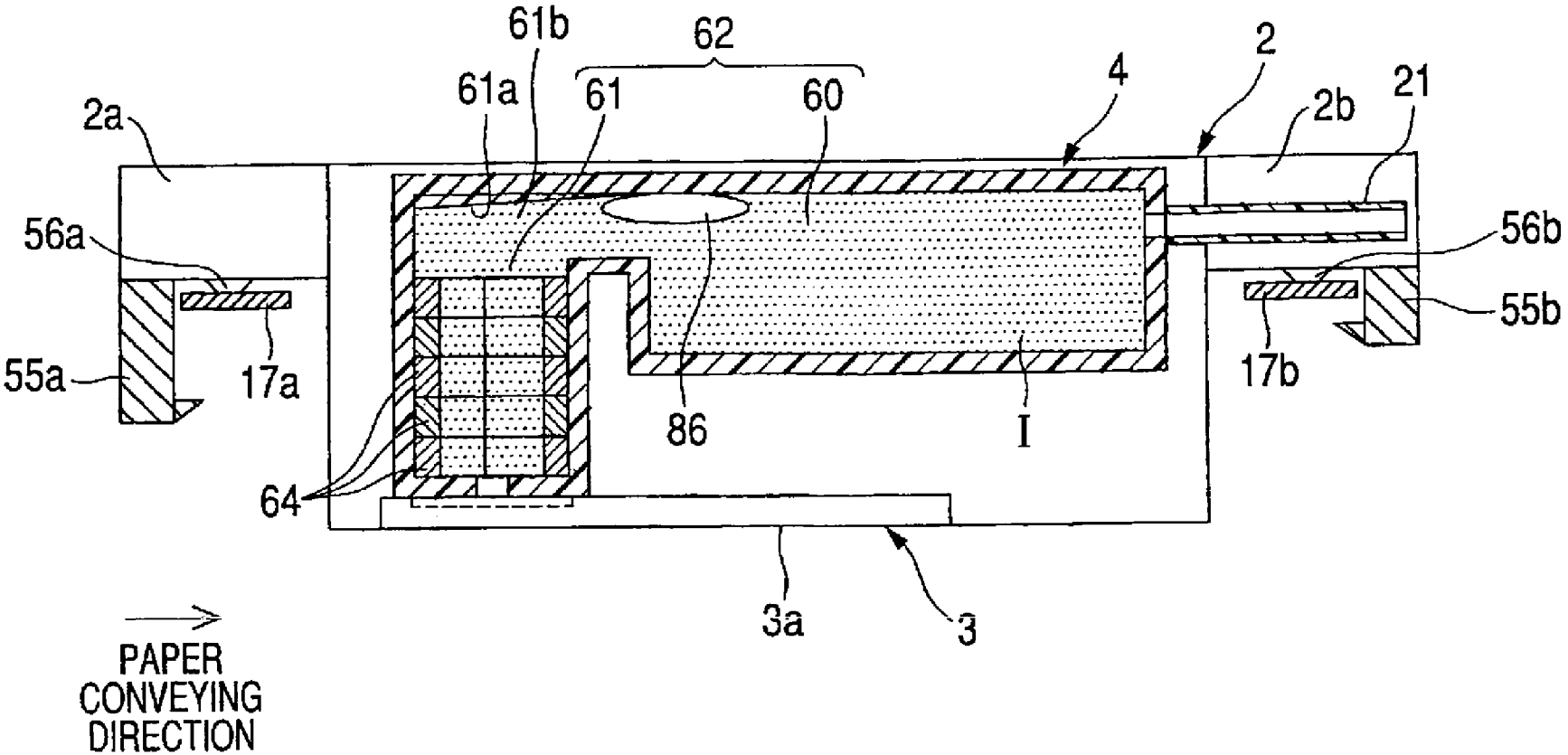
FIG. 8 is a vertical cross-sectional view of the carriage in a state immediately prior to ink ejection.

As shown in FIG. 8, when ink droplets are ejected through the plurality of nozzles 40 of the inkjet head 3 for recording (printing) images and the like on the recording paper P, the carriage 2 is held in the horizontal orientation while the two abutting sections 56*a* and 56*b* abut on the two guide frames 17*a* and 17*b*, respectively. Thus, if an air bubble 86 has entered the ink supplying channel 62 in the subsidiary tank 4 including the ink storing chamber 60 and the communication channel 61, the air bubble 86 stays at the upper part of the ink supplying channel 62 due to buoyancy. In addition, because the sloped surface 61*a* sloping upward toward the ink storing chamber 60 side is provided on the ceiling surface of the connection section 61*b* between the ink storing chamber 60 and the communication channel 61, the air bubble 86 stays within the ink storing chamber 60.

Figure 9:
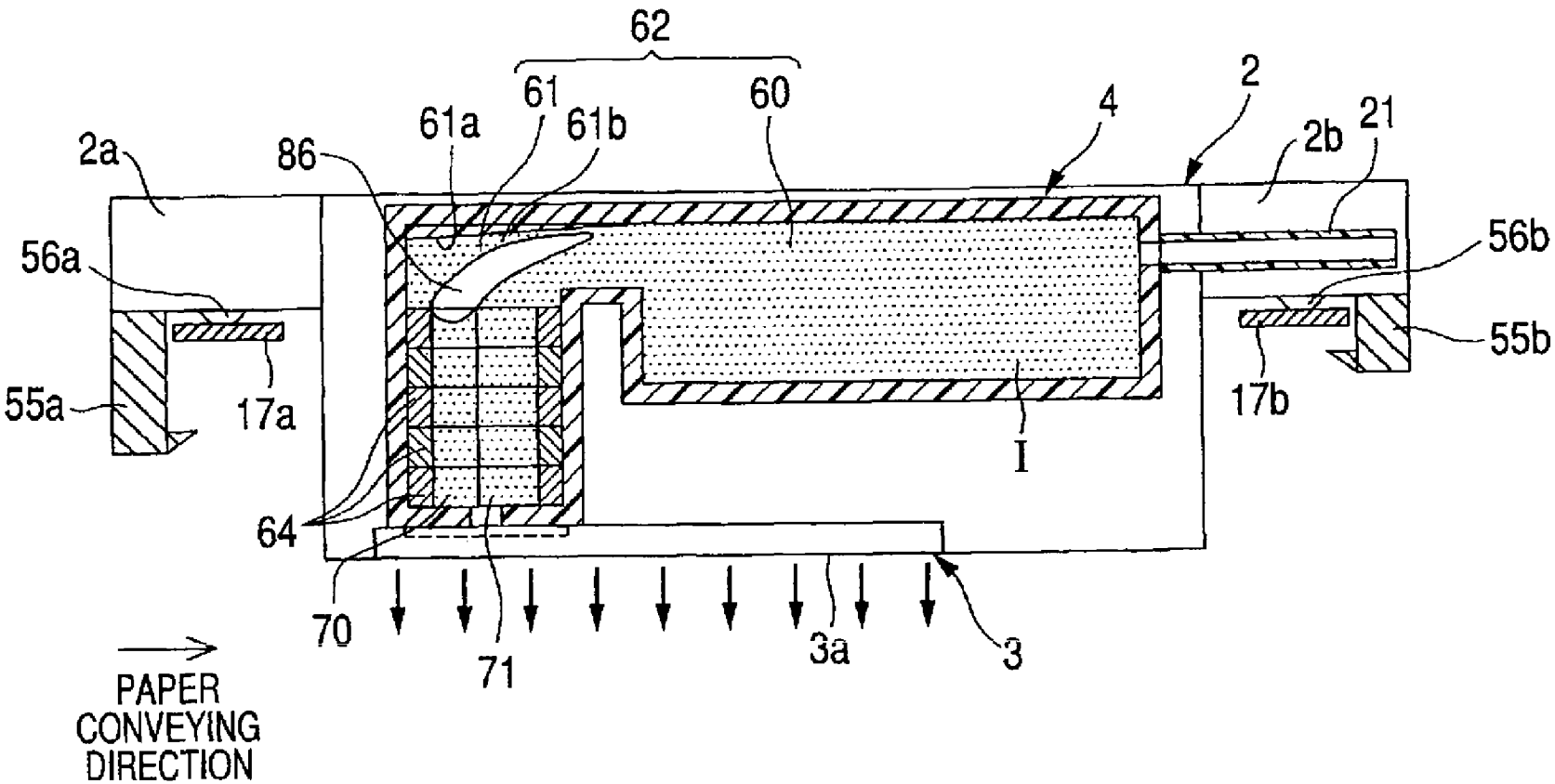
FIG. 9 is a vertical cross-sectional view of the carriage in a state during ink ejection.

As shown in FIG. 9, if ink droplets are ejected (consumed) through the nozzles 40 of the inkjet head 3 in this state, a force in the direction toward the communication channel 61 acts on the air bubble 86 in the ink storing chamber 60 due to the flow of ink I flowing from the ink storing chamber 60 toward the inkjet head 3 via the communication channel 61. However, the air bubble 86 does not easily move from the ink storing chamber 60 to the communication channel 61 because of the above-described sloped surface 61*a*.

Further, the plurality of flow adjusting members 64 is arranged within the communication channel 61. Hence, even if the air bubble 86 has moved to the communication channel 61 from the ink storing chamber 60 regardless of the sloped surface 61*a*, the plurality of flow adjusting members 64 restricts the movement of the air bubble 86 to the inkjet head 3. That is, the air bubble 86 gets on the flow of the ink I in the communication channel 61 and enters slightly in the low-resistance channel 70 formed in the flow adjusting members 64 having a low flow resistance. However, because the amount of the ink I discharged through the nozzles 40 is small, the flow velocity of ink within the communication channel 61 is relatively slow. Further, because the plurality of flow adjusting members 64 is juxtaposed in the direction in which ink flows (the channel extending direction of the communication channel 61), the air bubble 86 is caught by the flow adjusting members 64 and does not reach the inkjet head 3. Additionally, the flow adjusting members 64 are formed with the high-resistance channel 71 in communication with the low-resistance channel 70, as well as the low-resistance channel 70. Hence, even if the low-resistance channel 70 is almost blocked by the air bubble 86, the ink I in the ink storing chamber 60 flows to the inkjet head 3 via the high-resistance channel 71 of the flow adjusting members 64. Thus, ink supply to the inkjet head 3 is not blocked by the air bubble 86.

2) Ink Suction by Suction Pump 14

The droplet ejection performance of the inkjet head 3 decreases when ink with high viscosity (ink with increased viscosity) exists in the nozzles 40 due to drying or when the air bubble 86 in the subsidiary tank 4 has entered the inkjet head 3. In these cases, the suction control section 82 controls the cap drive motor 75 to put the cap member 13 on the droplet ejecting surface 3*a* of the inkjet head 3, and subsequently controls the suction pump 14 to suck ink through the nozzles 40, thereby discharging ink with increased viscosity in the nozzles 40 and the air bubble 86 in the subsidiary tank 4 to inside the cap member 13.

More specifically, first, the carriage drive motor 19 drives the carriage 2 to move to the maintenance position, such that the inkjet head 3 is in confrontation with the cap member 13. In this state, the suction control section 82 controls the cap drive motor 75 to drive the cap member 13 to move upward from the standby position. Then, as shown in FIG. 10, the cap member 13 is attached closely to the droplet ejecting surface 3*a* of the inkjet head 3 and further presses the droplet ejecting surface 3*a* upward. Thus, the carriage 2 supporting the inkjet head 3 and the subsidiary tanks 4 is tilted in such a manner that the upstream side of the carriage 2 in the paper conveying direction is located at a position higher than the downstream side.

At this time, as shown in FIG. 10, in the ink supplying channel 62 of the subsidiary tank 4, the connection section

61*b* between the ink storing chamber 60 and the communication channel 61 (the upper end section of the communication channel 61) is located at a position higher than the ink storing chamber 60. Hence, the air bubble 86 in the ink storing chamber 60 moves to the upper end section of the communication channel 61 due to buoyancy.

In this state, the suction control section 82 controls the suction pump 14 to suck air through a hermetically-closed space formed by the droplet ejecting surface 3*a* and the cap member 13, thereby forcibly discharging ink through the nozzles 40. Here, the air bubble 86 is already moved to the upper end section of the communication channel 61 from the ink storing chamber 60. Thus, as shown in FIG. 11, the air bubble 86 easily moves to the inkjet head 3 with the flow of ink I generated within the communication channel 61 by ink suction through the nozzles 40.

Additionally, the plurality of flow adjusting members 64 arranged within the communication channel 61 facilitates the movement of the air bubble 86 to the inkjet head 3. That is, during the ink suction by the suction pump 14, because a larger amount of ink I than in the droplet ejecting operation of FIG. 9 is discharged through the nozzles 40, the ink pressure at the inkjet head 3 side drops greatly, and the flow velocity of ink within the communication channel 61 becomes high. Then, as shown in FIG. 11, with the flow of ink I with a large flow velocity, the air bubble 86 passes through the low-resistance channel 70 formed in each of the plurality of flow adjusting members 64 to reach the inkjet head 3, and is discharged through the nozzles 40 with ink I.

At this time, because the ink flow velocity increases in the communication channel 61 as compared with the droplet ejection shown in FIG. 9, less ink flows in the high-resistance channel 71 having a high flow resistance. Hence, the amount of ink I that flows from the communication channel 61 of the subsidiary tank 4 to the inkjet head 3 decreases, thereby reducing the amount of ink I that is discharged through the nozzles 40 together with the air bubble 86.

As described above with reference to FIG. 11, the low-resistance channel 70 of each of the flow adjusting members 64 is located in a region within the communication channel 61 where the flow velocity of ink I is larger than the high-resistance channel 71. Hence, during the ink suction through the nozzles 40 by the suction pump 14, the air bubble 86 staying at the upper end section of the communication channel 61 easily passes through the low-resistance channel 70 of the plurality of flow adjusting members 64, allowing the air bubble 86 to be discharged more reliably.

In the above description, the ink suction operation by the suction pump 14 has been described with a focus on discharging the air bubble 86 in the subsidiary tank 4 located at the upstream side of the inkjet head 3 in the ink flowing direction. As mentioned above, however, the ink suction operation by the suction pump 14 could be performed with the main purpose of discharging ink with increased viscosity in the inkjet head 3 (especially, within the nozzles 40). In this case, it is not preferable that the air bubble 86 in the subsidiary tank 4 move to the inkjet head 3 due to a large amount of ink discharged through the nozzles 40 by suction. This is because the air bubble 86 enters the ink channel of the inkjet head 3, which decreases the droplet ejection performance.

Hence, in the present embodiment, by changing the ink suction amount of the suction pump 14, the suction control section 82 controls the suction pump 14 to selectively executes either one of: a first suction mode for discharging ink with increased viscosity and for sucking a small amount of ink; and a second suction mode for discharging the air bubble 86 in the subsidiary tank 4 and for sucking a large amount of ink.

If droplets are not ejected through the nozzles 40 for a predetermined time period, the suction control section 82 selects the first suction mode in which the suction amount is small, and controls the suction pump 14 to perform suction for a relatively small amount (short period). At this time, the air bubble 86 in the subsidiary tank 4 moves downward within the communication channel 61 to some extent. However, because the ink suction amount through the nozzles 40 is small, the air bubble 86 does not reach the inkjet head 3 and returns upward when the suction by the suction pump 14 ends. In other words, the air bubble 86 is not sent to the inkjet head 3 when the first suction mode is selected. To put it another way, the ink suction amount in the first suction mode can be set to the ink suction amount with which the air bubble 86 does not reach the inkjet head 3, taking the volume of the communication channel 61 and the like into consideration.

On the other hand, if the suction control section 82 determines that the air bubble 86 stays within the ink supplying channel 62 of the subsidiary tank 4, the suction control section 82 selects the second suction mode in which the ink suction amount is large, and controls the suction pump 14 to perform suction for a larger amount (longer suction period) than the above-described first suction mode. The suction control section 82 determines that the air bubble 86 stays within the ink supplying channel 62 if an exchange of the ink cartridge 6 is detected by the cartridge detecting sensor 95 (see FIG. 7) provided to the holder 10 (see FIG. 1), if the air bubble 86 in the subsidiary tank 4 is not discharged for a long period of time, or the like. In this case, the air bubble 86 in the communication channel 61 moves to the inkjet head 3, passes through the ink channel in the inkjet head 3, and is discharged through the nozzles 40 together with ink.

In this way, if the ink suction amount by the suction pump 14 is small, the air bubble 86 existing in the ink supplying channel 62 at the upstream side of the inkjet head 3 does not reach the inkjet head 3. Using this, two suction modes with different purposes can be switched easily by changing the suction amount of the suction pump 14, the two suction modes being for discharging ink with increased viscosity within the nozzles 40 and for discharging the air bubble 86 in the subsidiary tank 4.

According to the printer 1 of the present embodiment, the following effects can be obtained. When the cap member 13 is moved from the standby position to the capping position, the cap member 13 presses the droplet ejecting surface 3*a* of the inkjet head 3 upward, thereby tilting the inkjet head 3 and the subsidiary tanks 4 integrally. At this time, the subsidiary tank 4 is tilted in such a manner that the connection section 61*b* between the ink storing chamber 60 and the communication channel 61 is located at a position higher than the ink storing chamber 60 located at the upstream side of the connection section 61*b* in the ink flowing direction. Hence, the air bubble 86 staying at the upper section of the ink storing chamber 60 moves to the connection section 61*b* between the ink storing chamber 60 and the communication channel 61, the connection section 61*b* being located at the downstream side of the ink storing chamber 60 in the ink flowing direction. Thus, the air bubble 86 easily moves to the inkjet head 3 when ink is sucked through the nozzles 40 of the inkjet head 3 which are in communication with the communication channel 61. That is, the air bubble 86 can be easily discharged through the nozzles 40, and the amount of ink discharged at that time can be reduced.

Further, the air bubble 86 can be moved to the downstream side in the ink flowing direction by tilting the subsidiary tank 4 in conjunction with the capping operation of the cap member 13, which is executed immediately before ink is sucked through the nozzles 40 by the suction pump 14. Hence, no special configuration for tilting the subsidiary tank 4 is necessary.

The ceiling surface 61*a* of the connection section 61*b* between the ink storing chamber 60 and the communication channel 61 is sloped upward toward the ink storing chamber 60 side, in a state where the cap member 13 is at the standby position and where the inkjet head 3 and the subsidiary tank 4 are not tilted by the cap member 13 (a state where the carriage 2 is in the horizontal orientation) Hence, in this state, the air bubble 86 in the ink storing chamber 60 does not move easily to the communication channel 61 side. Accordingly, when droplets are ejected through the nozzles 40 for printing images and the like, the air bubble 86 in the ink storing chamber 60 is prevented from moving toward the downstream side in the ink flowing direction with the flow of ink I that flows from the ink storing chamber 60 to the inkjet head 3 via the communication channel 61.

While the invention has been described in detail with reference to the above aspects thereof, it would be apparent to those skilled in the art that various changes and modifications may be made therein without departing from the scope of the claims. Here, like parts and components are designated by the same reference numerals to avoid duplicating description.

[1] The configuration for tilting the carriage 2 supporting the inkjet head 3 and the subsidiary tanks 4 is not limited to the configuration in the above-described embodiment. For example, instead of the two guide frames 17*a* and 17*b* in the above-described embodiment, a shaft extending in the horizontal direction may be provided. A carriage is supported on the shaft slidably movably in the scanning direction. The carriage is also rotatable about the shaft. The carriage is configured to be tilted from the horizontal orientation by rotating about the shaft, when the droplet ejecting surface 3*a* of the inkjet head 3 is pressed upward by the cap member 13 that is moving upward.

[2] The shape of a flow adjusting member (the shape, the location, and the like of a through-hole forming a low-resistance channel and a high-resistance channel) provided in the communication channel 61 is not limited to the shape in the above-described embodiment (see FIG. 4).

For example, in a region within the communication channel 61 that is away from the connection section 61*b* between the communication channel 61 and the ink storing chamber 60, the ink flow velocity becomes the largest at the center section (in the upper-lower direction in FIG. 12) farthest away from the side walls of the communication channel 61. Hence, as shown in FIG. 12, if a plurality of flow adjusting member 64A is provided in such a region, it is preferable that a large through-hole 65A serving as a low-resistance channel 70A for passing an air bubble therethrough be arranged at the center region of each of the flow adjusting members 64A, and that through-holes 66A (elongated holes) serving as high-resistance channels 71A be arranged at the peripheral regions (both side regions) of the through-hole 65A.

Figure 12:
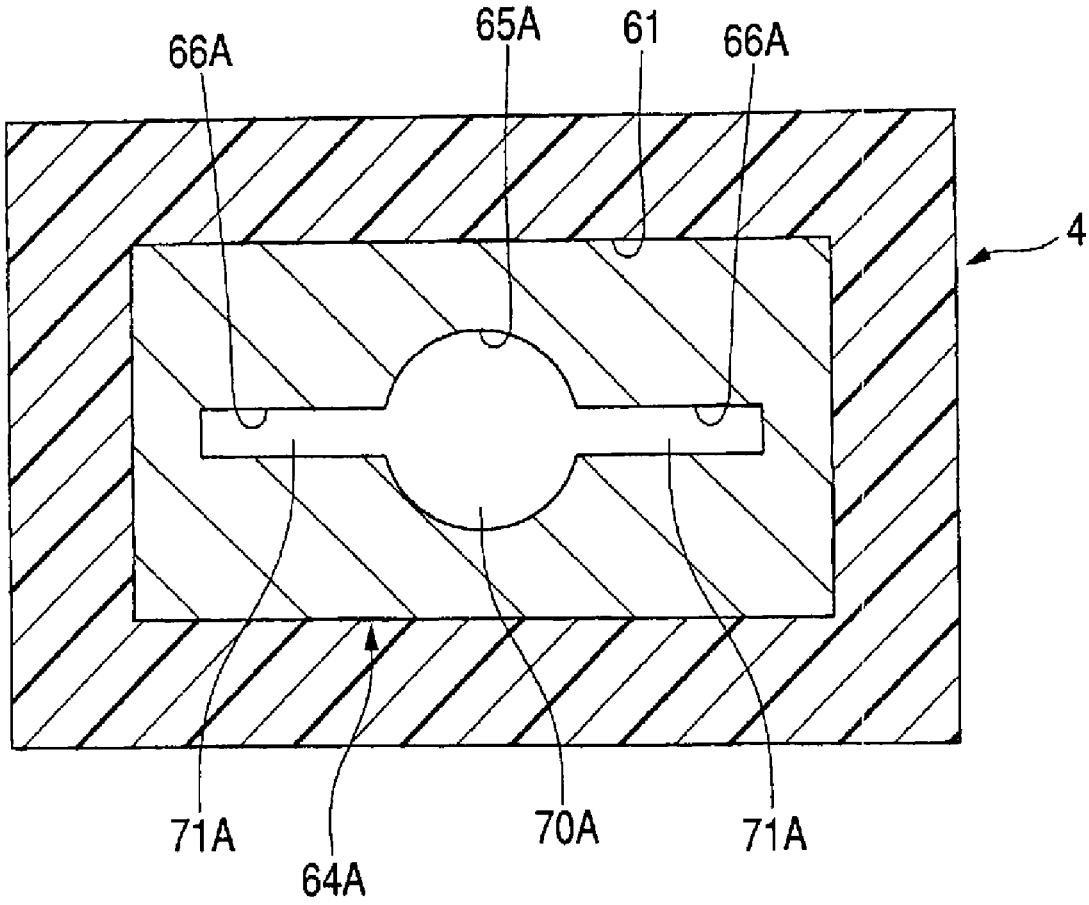
FIG. 12 is a cross-sectional view of a flow adjusting member according to a modification, wherein the cross-section corresponds to FIG. 4.

Although the triangular hole 65 serving as the low-resistance channel 70 has a triangular shape in the above-described embodiment, the through-hole 65A serving as the low-resistance channel 70A has a circular shape as shown in FIG. 12. Alternatively, various shapes such as an elliptical shape and a rectangular shape may be used. Also, the shape of the through-hole 66A serving as the high-resistance channel 71A is not limited to an elongated-hole shape. Various shapes can be adopted as long as the high-resistance channel 71A formed by the through-hole 66A has a higher flow resistance than the low-resistance channel 70A.

Further, in the above-described embodiment, a single number of the high-resistance channel 71 is formed in each of the flow adjusting members 64. In the present modification, however, two high-resistance channels 71A are formed in each of the flow adjusting members 64A as shown in FIG. 12. In this case, as shown in FIG. 12, it is preferable that the two high-resistance channels 71A be arranged at symmetrical positions with respect to the low-resistance channel 70A, so that ink does not flow unevenly within the communication channel 61.

In the above-described embodiment and modifications, the invention is applied to an inkjet-type printer which records images and the like by ejecting ink droplets on recording paper. However, the application of the invention is not limited to such a printer. That is, the invention can be applied to various droplet ejecting devices that eject various kinds of liquid on an object, depending on the usage.

What is claimed is:

1. A droplet ejecting device comprising:

a droplet ejecting head having a droplet ejecting surface formed with droplet ejecting openings that eject liquid droplets;

a channel member configured to be tilted together with the droplet ejecting head, the channel member being formed with a liquid supplying channel including a liquid storing chamber and a communication channel in communication with each other via a connection section, an upper section of the liquid storing chamber being in communication with the communication channel via the connection section, the liquid storing chamber being in communication with the droplet ejecting head via the communication channel;

a cap member configured to be movable between:

a standby position spaced away from the droplet ejecting surface; and a capping position at which the cap member is in close contact with the droplet ejecting surface and covers the droplet ejecting openings; and a cap drive section that drives the cap member to move between the standby position and the capping position, wherein, when the cap drive section drives the cap member to move to the capping position, the cap member presses the droplet ejecting head, and the channel member is tilted together with the droplet ejecting head in such a manner that the connection section is located at a position higher than the liquid storing chamber when the droplet ejecting device is placed in an orientation in which the droplet ejecting device is intended to be used.

2. The droplet ejecting device according to claim 1, wherein a flow adjusting member is provided in the communication channel; and wherein the flow adjusting member is formed with a low-resistance channel and a high-resistance channel, the high-resistance channel being formed integrally with the low-resistance channel and having a higher flow resistance than the low-resistance channel.

3. The droplet ejecting device according to claim 2, wherein the flow adjusting member comprises a plurality of flow adjusting members that is arranged in a channel extending direction in which the communication channel extends.

4. The droplet ejecting device according to claim 1, further comprising a suction section connected to the cap member, the suction section being configured to suck liquid and an air bubble in the liquid supplying channel through the droplet ejecting openings.

5. The droplet ejecting device according to claim 4, further comprising a suction control section that controls a suction operation of the suction section, wherein the suction control section controls the suction section to change an amount of liquid sucked through the droplet ejecting openings and to selectively perform either one of:

a first suction mode for discharging liquid in the droplet ejecting head; and a second suction mode for discharging, together with liquid, an air bubble in the liquid supplying channel.

6. The droplet ejecting device according to claim 1, wherein the droplet ejecting openings eject ink droplets on a recording medium; and wherein the droplet ejecting device functions as an inkjet recording device.

7. A droplet ejecting device comprising:

a droplet ejecting head having a droplet ejecting surface formed with droplet ejecting openings that eject liquid droplets;

a channel member configured to be tilted together with the droplet ejecting head, the channel member being formed with a liquid supplying channel including a liquid storing chamber and a communication channel in communication with each other via a connection section, the liquid storing chamber being in communication with the droplet ejecting head via the communication channel;

a cap member configured to be movable between:

a standby position spaced away from the droplet ejecting surface; and a capping position at which the cap member is in close contact with the droplet ejecting surface and covers the droplet ejecting openings; and a cap drive section that drives the cap member to move between the standby position and the capping position, wherein, when the cap drive section drives the cap member to move to the capping position, the cap member presses the droplet ejecting head, and the channel member is tilted together with the droplet ejecting head in such a manner that the connection section is located at a position higher than the liquid storing chamber when the droplet ejecting device is placed in an orientation in which the droplet ejecting device is intended to be used, wherein the connection section has a ceiling surface, and wherein the ceiling surface is sloped upward toward a liquid storing chamber side when the cap member is in the standby position at which the droplet ejecting head and the channel member are not tilted by the cap member.

8. A droplet ejecting device comprising:

a droplet ejecting head having a droplet ejecting surface formed with droplet ejecting openings that eject liquid droplets;

a channel member configured to be tilted together with the droplet ejecting head, the channel member being formed with a liquid supplying channel including a liquid storing chamber and a communication channel in communication with each other via a connection section, the liquid storing chamber being in communication with the droplet ejecting head via the communication channel;

a cap member configured to be movable between:

a standby position spaced away from the droplet ejecting surface; and a capping position at which the cap member is in close contact with the droplet ejecting surface and covers the droplet ejecting openings;

a cap drive section that drives the cap member to move between the standby position and the capping position;

a support member that supports the droplet ejecting head and the channel member, the support member having a first side located at a connection section side and a second side located at a liquid storing chamber side;

first and second guide members each extending in a first horizontal direction, the first and second guide members being arranged in parallel with each other and with a space therebetween in a second horizontal direction, the second horizontal direction being a direction in which liquid flows from the liquid storing chamber toward the connection section, the first guide member being located at the first side, the second guide member being located at the second side, thereby guiding the support member in the first horizontal direction; and a support-member drive mechanism that drives the support member to move in the first horizontal direction, wherein, when the cap drive section drives the cap member to move to the capping position, the cap member presses the droplet ejecting head, and the channel member is tilted together with the droplet ejecting head in such a manner that the connection section is located at a position higher than the liquid storing chamber when the droplet ejecting device is placed in an orientation in which the droplet ejecting device is intended to be used wherein the support member is mounted on the first and second guide members in such a manner that the first side of the support member is movable in a vertical direction relative to the first guide member and that the second side of the support member is movable in the vertical direction relative to the second guide member;

wherein the first side of the support member is movable vertically relative to the first guide member by a first amount; and wherein the second side of the support member is movable vertically relative to the second guide member by a second amount, the first amount being larger than the second amount.

9. The droplet ejecting device according to claim 8, wherein the support member comprises:

a first abutting section provided at the first side and configured to abut on the first guide member when the cap member is in the standby position;

a second abutting section provided at the second side and configured to abut on the second guide member when the cap member is in the standby position;

a first engaging section provided at the first side and configured to engage the first guide member when the cap member is in the capping position, thereby preventing further upward movement of the first side of the support member; and a second engaging section provided at the second side and configured to engage the second guide member when the cap member is in the capping position, thereby preventing further upward movement of the second side of the support member;

wherein a distance between the first abutting section and the first engaging section in the vertical direction is larger than a distance between the second abutting section and the second engaging section in the vertical direction; and wherein the first side and the second side of the support member are located at a substantially same height when the cap member is in the standby position, and the first side of the support member is located at a position higher than the second side of the support member when the cap member is in the capping position.

10. The droplet ejecting device according to claim 8, wherein the cap drive section comprises:

a cap holder that holds the cap member, the cap holder having a cap-holder engaging section;

a lift holder provided at a lower side of the cap holder;

a spring disposed between the cap holder and the lift holder and configured to urge the cap holder upward;

a cap drive motor that drives the lift holder to move upward;

wherein, when the cap drive motor does not drive the lift holder to move upward, the cap-holder engaging section engages the lift holder and restricts further upward movement of the cap holder, thereby placing the cap member in the standby position; and wherein, when the cap drive motor drives the lift holder to move upward, an engagement between the cap-holder engaging section and the lift holder is released and the cap holder is capable of tilting freely with respect to a horizontal direction, thereby placing the cap member in the capping position.

11. The droplet ejecting device according to claim 8, wherein the support-member drive mechanism comprises:a belt connected to the support member; and a belt drive section that drivingly moves the belt.

12. The droplet ejecting device according to claim 11, wherein the belt is connected to the support member at a position opposite to the connection section with respect to the liquid storing chamber.

* * * * *